US009635927B2

(12) United States Patent
Godin et al.

(10) Patent No.: US 9,635,927 B2
(45) Date of Patent: May 2, 2017

(54) BRUSH HEAD WITH RECESSED BRISTLES, BRUSH, METHOD OF MAKING AND METHOD OF USING SAME

(71) Applicant: Bare Escentuals Beauty, Inc., San Francisco, CA (US)

(72) Inventors: Sarina Godin, Oakland, CA (US); Jennifer Allen, San Francisco, CA (US)

(73) Assignee: Bare Escentuals Beauty, Inc., San Francisco, CA (US)

( * ) Notice: Subject to any disclaimer, the term of this patent is extended or adjusted under 35 U.S.C. 154(b) by 0 days.

(21) Appl. No.: 14/447,974

(22) Filed: Jul. 31, 2014

(65) Prior Publication Data

US 2015/0265039 A1 Sep. 24, 2015

Related U.S. Application Data

(63) Continuation-in-part of application No. 29/485,705, filed on Mar. 21, 2014.

(51) Int. Cl.
*A46B 9/02* (2006.01)

(52) U.S. Cl.
CPC ..... *A46B 9/028* (2013.01); *A46B 9/021* (2013.01)

(58) Field of Classification Search
CPC ..... A46B 9/028; A46B 9/02; A46B 9/021; A46B 15/00
See application file for complete search history.

(56) References Cited

U.S. PATENT DOCUMENTS

| | | | | |
|---|---|---|---|---|
| 421,812 A | | 2/1890 | Bonner | |
| 925,178 A | | 6/1909 | Hardman | |
| 955,061 A | | 4/1910 | Erskine | |
| 1,092,710 A | | 4/1914 | Hartman | 15/191.1 |
| 1,106,378 A | | 8/1914 | Hardman | |
| 1,120,476 A | * | 12/1914 | Hansen | A46B 15/00 15/104.94 |

(Continued)

FOREIGN PATENT DOCUMENTS

| | | | | |
|---|---|---|---|---|
| DE | 202014003461 U1 | * | 5/2014 | |
| FR | 663618 A | | 8/1929 | A45D 27/04 |

OTHER PUBLICATIONS

MakeupByJoyce—Brush Reviews, Mar. 2013 [online], Sigma F80 Cosmetic Brush, pp. 2-3 [retrieved on Dec. 31, 2014]; Retrieved from the Internet using Web Archive:<URL:http://web.archive.org/web/*/http://www.makeupbyjoyce.com>.

(Continued)

*Primary Examiner* — Shay Karls
(74) *Attorney, Agent, or Firm* — Flaster/Greenberg P.C.

(57) ABSTRACT

The present invention recognizes that there exists a long felt need for brush heads and brushes having material application and buffing properties. A first aspect of the present invention is a brush head. A second aspect of the present invention is a brush including a brush head of the present invention. A third aspect of the present invention is a method of making a brush head of the present invention. A fourth aspect of the present invention is a method of making a brush of the present invention. A fifth aspect of the present invention is a method of using a brush head of the present invention. A sixth aspect of the present invention is a method of using a brush of the present invention.

32 Claims, 7 Drawing Sheets

(56) References Cited

U.S. PATENT DOCUMENTS

| | | | | |
|---|---|---|---|---|
| 1,197,210 | A | 9/1916 | Jordan | |
| 1,247,484 | A | 11/1917 | Albrecht, Jr. | |
| 1,359,733 | A | 11/1920 | Palmer | |
| 1,981,851 | A | 11/1924 | Aten | 15/244.1 |
| 1,563,031 | A | 11/1925 | Jones | |
| D73,782 | S | 11/1927 | Fuld | |
| 1,694,364 | A * | 12/1928 | Albright | A46B 15/00 15/159.1 |
| 1,749,052 | A | 3/1930 | Watt | |
| 1,763,905 | A | 6/1930 | Rusell | |
| 1,858,452 | A | 5/1932 | Lancellotti | |
| 1,923,884 | A | 8/1933 | Pushee | 300/21 |
| 1,956,477 | A | 4/1934 | Segal | |
| 2,145,570 | A | 1/1939 | Miettunen | |
| 2,240,547 | A | 5/1941 | Buddish | |
| 2,548,429 | A | 4/1951 | Fitzgerald | |
| 3,309,727 | A | 3/1967 | Snodderly | 15/160 |
| 3,653,090 | A | 4/1972 | Weaver | |
| 3,978,852 | A | 9/1976 | Annoni | |
| 4,454,622 | A | 6/1984 | Poppendieck | |
| 4,626,119 | A | 12/1986 | Ladd, Jr. | |
| 4,944,625 | A | 7/1990 | Futter | |
| 5,195,546 | A | 3/1993 | Cansler | |
| 5,373,599 | A | 12/1994 | Lemon | |
| 6,224,287 | B1 | 5/2001 | Gieux | |
| D450,930 | S | 11/2001 | Mink | |
| 6,347,425 | B1 | 2/2002 | Fattori | |
| 6,490,747 | B1 | 12/2002 | Metwally | |
| D480,217 | S | 10/2003 | Mink | |
| 6,795,997 | B1 | 9/2004 | Lin | |
| D571,105 | S | 6/2008 | Godin | D4/119 |
| D601,804 | S | 10/2009 | Hwang | |
| 8,060,971 | B1 | 11/2011 | Castelluccio | |
| 8,104,132 | B2 * | 1/2012 | Mink | A45D 40/262 15/160 |
| D663,957 | S | 7/2012 | Garcia | D4/135 |
| D692,672 | S | 11/2013 | Chan et al. | D4/128 |
| D697,314 | S | 1/2014 | Tronconi | |
| 8,678,693 | B2 | 3/2014 | Sturgis | 401/287 |
| 8,777,507 | B1 | 7/2014 | Carey | |
| 2001/0052160 | A1 | 12/2001 | Dorf | |
| 2004/0107521 | A1 | 6/2004 | Chan | |
| 2004/0134002 | A1 | 7/2004 | Zimmer | |
| 2005/0045200 | A1 * | 3/2005 | Zeunik | A45D 27/04 132/290 |
| 2005/0138746 | A1 | 6/2005 | Young-Chul | |
| 2005/0188999 | A1 | 9/2005 | Byun | |
| 2006/0090277 | A1 | 5/2006 | Petit | |
| 2007/0177930 | A1 | 8/2007 | Byun | |
| 2008/0063672 | A1 | 3/2008 | Mandelli | |
| 2009/0089949 | A1 | 4/2009 | Mink | |
| 2009/0180825 | A1 | 7/2009 | Chang | |
| 2010/0021229 | A1 | 1/2010 | Byun | |
| 2010/0077559 | A1 | 4/2010 | Mink | |
| 2010/0095973 | A1 | 4/2010 | Shrier | |
| 2010/0101035 | A1 | 4/2010 | Nakamura | |
| 2012/0260931 | A1 | 10/2012 | Martin | |
| 2012/0272982 | A1 | 11/2012 | Telwar | |
| 2014/0325775 | A1 | 11/2014 | Nakamura et al. | 15/160 |

OTHER PUBLICATIONS

Care Makeup—Brushes and Tools, Sep. 2011 [online], Shiseido Foundation Brush, pp. 10-11, [retrieved on Jan. 8, 2015]; Retrieved from the Internet using Web Archive:<http://web.archive.org/web/*/http://ww/cafremakeup.com>.

Materials from Bare Escentuals Beauty, Inc. at email@bareescentuals.com (obtained Feb. 19, 2014, per document itself).

Materials from Loew Cornell at www.lowe-cornell.com (obtained Mar. 12, 2014, per document itself).

Wettability, non-wettability and contact angle hysteresis, materials from http://web.mit.edu (obtained Jul. 17, 2014, per document itself).

Wetting, materials from http://en.wikipedia.org (obtained Jul. 17, 2014, per document itself).

Contact angle, materials from http://en.wikipedia.org (obtained Jul. 17, 2014, per document itself).

Standard Practices for Surface Wettability of Coatings, Substrates and Pigments for Advancing Contact Angle Measurements, materials from www.astm.org (obtained Jul. 17, 2014, per document itself).

BareSkin® Foundation, Pure Brightening Serum Foundation, materials from www.bareescentuals.com (obtained Jul. 16, 2014, per document itself).

Pefecting Face Brush, materials from www.bareescentuals.com (obtained Jul. 16, 2014, per document itself).

Materials from Bare Escentuals Beauty, Inc. at email@bareescentuals.com (obtained Jul. 10, 2014).

* cited by examiner

BRUSH HEAD WITH RECESSED BRISTLES, BRUSH, METHOD OF MAKING AND METHOD OF USING SAME

The present application is a Continuation-in-Part application of U.S. Design patent application Ser. No. 29/485,705, filed Mar. 21, 2014, entitled "Brush Head With Recessed Bristles," which is incorporated by reference herein in its entirety.

TECHNICAL FIELD

The present invention generally relates generally to the fields of brush heads, brushes, and method of making and using same.

BACKGROUND

A wide variety of brush heads and brushes are used for a variety of purposes, inclusive of cleaning and application of materials to surfaces for industry, hobby, artistic and cosmetic purposes, to name a few. Although the number and type of brushes are varied, none have the attributes of the brush heads and brushes of the present invention, being a brush head and brush with a section of recessed bristles. None are known to have the physical and material application characteristics of the present invention.

For example, U.S. Pat. No. D 663,957 S, issued Jul. 24, 2012 to Garcia, refers to a brush with an apparent gap in the central portion of the brush, wherein the brush is evidently used for hobby and fine art purposes. The central gap is apparently too small to accept a material, and if it were, the intent of the brush is apparently to smear or streak a material when applied to a surface for an artistic effect when in use for painting surfaces for a craft project or fine art projects, such as, for example, cups, plates, figurines, and paintings on canvas. A common problem with traditional brushes is the uneven application of makeup or other substance which may result in smears, streaks or an unnatural or undesirable look or appearance, particularly, but not limited, to the instance of the application of cosmetics. The present invention, however, is directed more towards preventing or reducing the appearance of such smears or streaks, but that need not be the case.

SUMMARY

The present invention recognizes that there exists a long felt need for brush heads and brushes having material application and buffing properties.

A first aspect of the present invention is a brush head.

A second aspect of the present invention is a brush including a brush head of the present invention.

A third aspect of the present invention is a method of making a brush head of the present invention.

A fourth aspect of the present invention is a method of making a brush of the present invention.

A fifth aspect of the present invention is a method of using a brush head of the present invention.

A sixth aspect of the present invention is a method of using a brush of the present invention.

Figure 1:
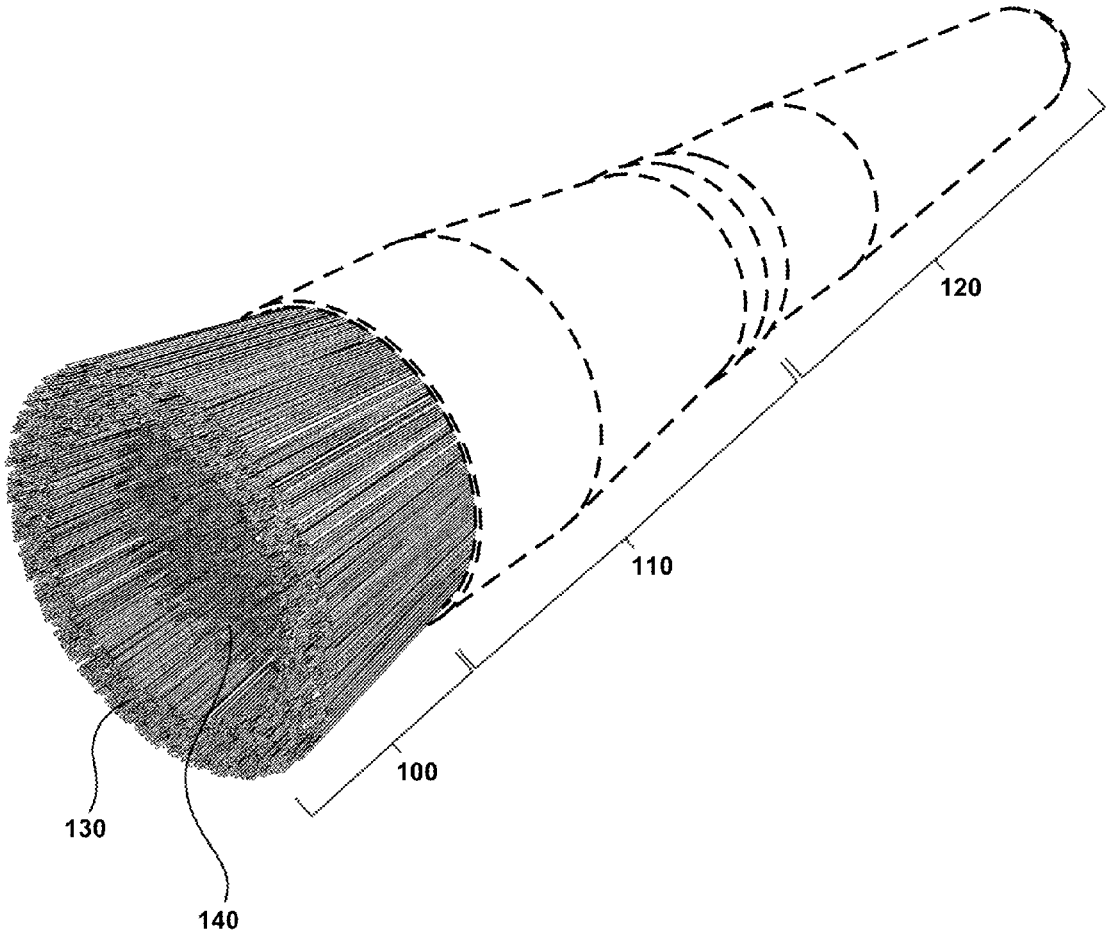
FIG. 1 generally depicts a front and right perspective view of one aspect of a brush head of the present invention with recessed bristles that can form a reservoir for material to be applied to a surface, such as but not limited to a liquid cosmetic material applied to a human subject's face, showing the environment inclusive of a ferrule and a handle. The brush as a whole can include a brush head (100), a ferrule (110) and a handle (120). The brush head can include an outer zone of bristles (130) and an inner zone of recessed bristles (140).
Figure 2:
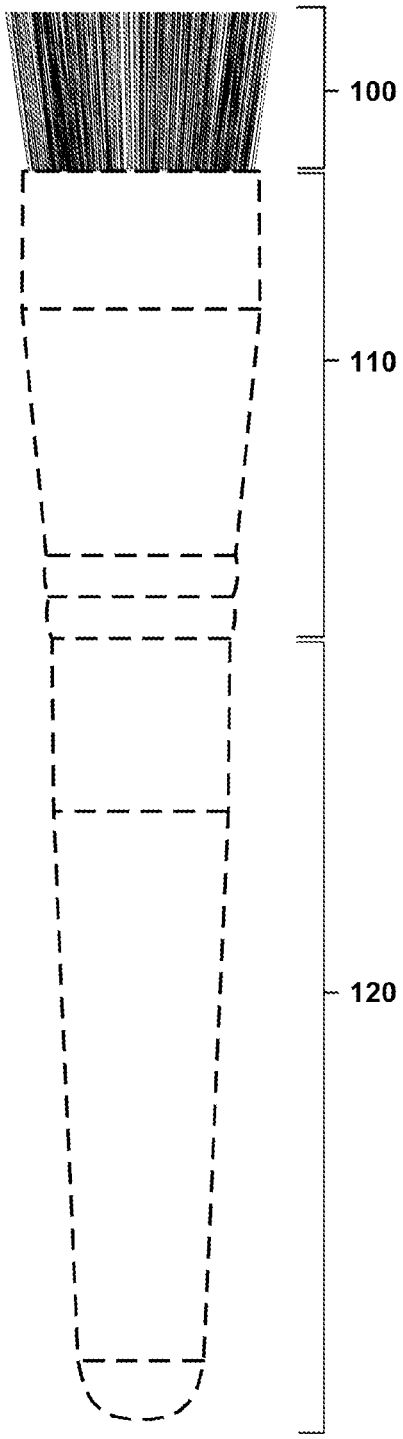
FIG. 2 generally depicts a right side view of one aspect of a brush head of the present invention with recessed bristles that can form a reservoir for material to be applied to a surface, such as but not limited to a liquid cosmetic material applied to a human subject's face, the left side, front side, and back side being mirror image thereof. The element numbers as are provided in FIG. 1.
Figure 3:
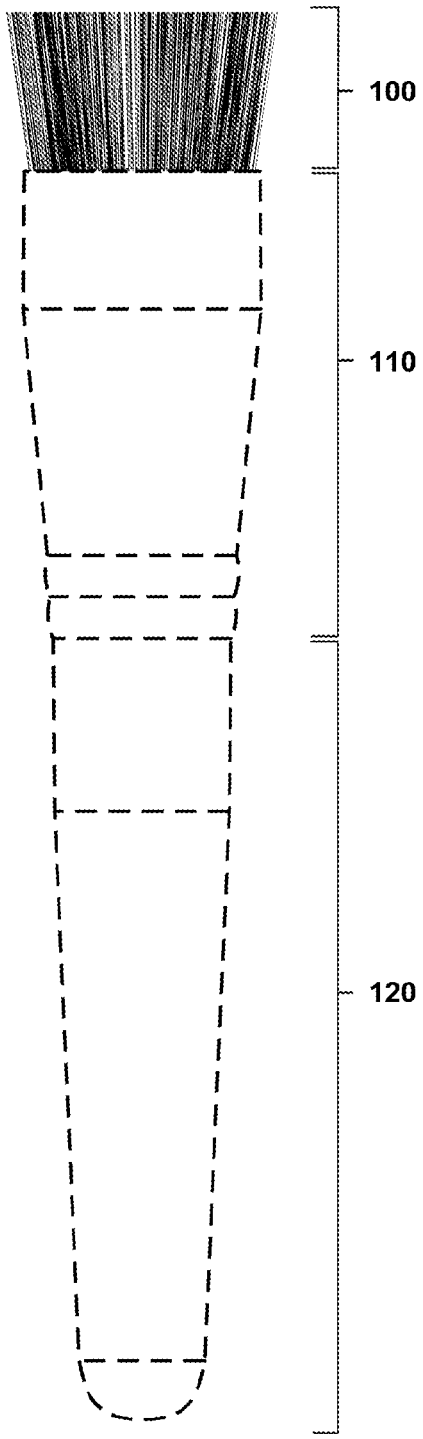
FIG. 3 generally depicts a left side, front side, and back side view of one aspect of a brush head of the present invention with recessed bristles that can form a reservoir for material to be applied to a surface, such as but not limited to a liquid cosmetic material applied to a human subject's face, as per FIG. 2. The element numbers as are provided in FIG. 1.
Figure 4:
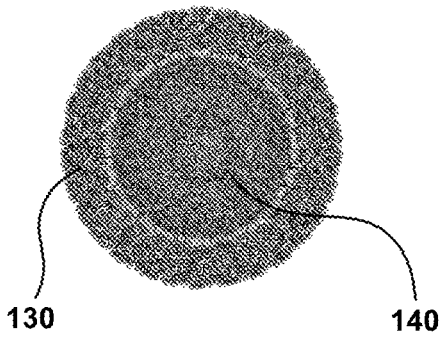
FIG. 4 generally depicts a top view of one aspect of a brush head of the present invention with recessed bristles that can form a reservoir for material to be applied to a surface, such as but not limited to a liquid cosmetic material applied to a human subject's face. The element numbers as are provided in FIG. 1.
Figure 5:
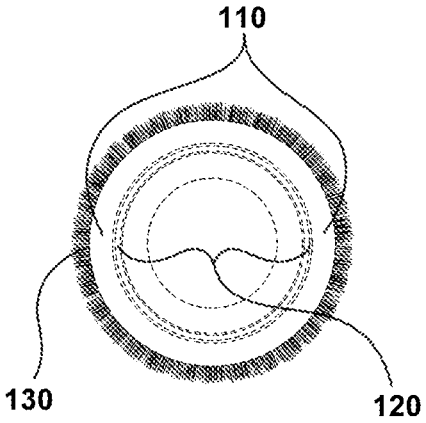
FIG. 5 generally depicts a bottom view of one aspect of a brush head of the present invention with recessed bristles that can form a reservoir for material to be applied to a surface, such as but not limited to a liquid cosmetic material applied to a human subject's face. The element numbers as are provided in FIG. 1.

The broken lines shown in the drawing, when present, are for illustrative purposes only and depict but one environment that the present invention can be provided, but that need not be the case.

DETAILED DESCRIPTION OF THE INVENTION

Definitions

Unless defined otherwise, all technical and scientific terms used herein have the same meaning as commonly understood by one of ordinary skill in the art to which this invention belongs. Generally, the nomenclature used herein and the laboratory procedures in brush heads and brushes in general, for cosmetics, surface chemistry and modification, and other applicable technologies described below are well known and commonly employed in the art. Where a term is provided in the singular, the inventors also contemplate the plural of that term, and when a term is provided in the plural, the inventors also contemplate the singular of that term. The nomenclature used herein and the laboratory procedures described below are those well-known and commonly employed in the art unless set forth otherwise. As employed throughout the disclosure, the following terms, unless otherwise indicated, shall be understood to have the following meanings:

Wettability and wetting refer to the ability of a liquid to absorb into a surface. For example, a drop of water on a household sponge would tend to wet the sponge, whereas a drop of water on common glass would not tend to wet the glass. Wettability or wetting can be a term of degree and not necessarily one of an absolute positive or negative result. This term and concept is well known in the art. (See, generally, for example: Wetting, at http://en.wikipedia.org/wiki/wetting, Contact Angle, at http://en.wikipedia.org/wiki/contact_angle, Standard Practice for Surface Wettability of Coating, Substrates and Pigments by Advancing Contact Angle Measurement, at http://www.astm.org/standards/d7334.htm, and 6) Wettability, non-wettability and contact angle hysteresis, at http://web.mit.edu.nnf/education/wettability/wetting.html.)

Contact angle determinations also refer to the ability of a surface to absorb a substance. A hydrophilic liquid being applied to a hydrophobic surface would tend to bead up on the surface and thus have a relatively high contact angle, as an example. A low or minimal contact angle would occur as the liquid is absorbed into or spread out upon a surface, such as a drop of water being applied to cellulose filter paper or household tissue paper or paper towels, or a drop of water on glass. Alternatively, a drop of water on the waxy coat of a leaf, or on the surface of a newly waxed automobile, would have a relatively high contact angle. This term and concept is well known in the art. (See, generally, for example: Wetting, at http://en.wikipedia.org/wiki/wetting, Contact Angle, at http://en.wikipedia.org/wiki/contact_angle, Standard Practice for Surface Wettability of Coating, Substrates and Pigments by Advancing Contact Angle Measurement, at http://www.astm.org/standards/d7334.htm, and 6) Wettability, non-wettability and contact angle hysteresis, at http://web.mit.edu.nnf/education/wettability/wetting.html.).

Reference in this specification to "one embodiment" or "an embodiment" means that a particular feature, structure, or characteristic described in connection with the embodiment is included in at least one embodiment of the disclosure. The use of the phrase "in one embodiment" or "in another embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a team is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Other technical terms used herein have their ordinary meaning in the art that they are used, as exemplified by a variety of technical dictionaries.

Introduction

The present invention recognizes that there exists a long felt need for brush heads and brushes having material application and buffing properties.

As a non-limiting introduction to the breadth of the present invention, the present invention includes several general and useful aspects, including:

1) A brush head.

2) A brush including a brush head of the present invention.

3) A method of making a brush head of the present invention.

4) A method of making a brush of the present invention.

5) A method of using a brush head of the present invention.

6) A method of using a brush of the present invention.

These aspects of the invention, as well as others described herein, can be achieved by using the methods, articles of manufacture and compositions of matter described herein. To gain a full appreciation of the scope of the present invention, it will be further recognized that various aspects of the present invention can be combined to make desirable embodiments of the invention.

I Brush Head

A first aspect of the present invention is a brush head that includes: a) an outer zone of bristles, and b) an inner zone of recessed bristles.

As depicted in the figures, showing a non-limiting preferred aspect of the present invention, an outer zone of bristles is present, which provides for an inner zone of recessed bristles. The brush head of the present invention need not have this particular configuration.

As an example, the outer zone need not be continuous and can have gaps and the like, nor need be uniform in thickness or height overall or relative to the inner zone. The surface of the outer zone may be of different lengths of bristles and can form different types of patterns, such as wavy, or have random or seemingly random lengths of bristles to provide for a "feathered" appearance.

As a further example, the inner zone also need not be continuous and can have gaps and the like, nor need be uniform in thickness or height overall or relative to the outer zone. The surface of the outer zone may be of different lengths of bristles and can form different types of patterns, such as wavy, or have random or seemingly random lengths of bristles to provide for a "feathered" appearance.

Further, the outer zone and the inner zone can be contiguous and not as distinct such as is shown in the figures. For example, the inner zone can be a concave configuration formed, for example, from a flat top brush where, for example, a hot wire is used to form a contiguous concave inner zone while forming an outer zone, where the outer zone can be substantial or minimal.

Type of Brush Head

In another aspect of the present invention, the brush head is a cosmetic brush head or a non-cosmetic brush head.

A preferred aspect of the present invention is a cosmetic applicator brush head, where a cosmetic is provided in a preferred embodiment to the inner zone for application to a surface of a subject, and outer zone preferably disperses the cosmetic on the surface of the subject to allow for reduced streaking and otherwise provide for generally more uniform and pleasing application of the cosmetic to a surface of a subject.

In addition to a cosmetic brush head, the brush head of the present invention can be used for the application of other materials to other surfaces and for other purposes. As an example, the brush head can be used for application of paints and other pigment containing materials such as ink to a surface. Industrial applications as well as artistic applications are a part of the present invention.

In addition, the brush head of the present invention is applicable for cleaning and the like. In that instance, a cleaning material such as a cleaning solution, can optionally be applied to the brush head and used for cleaning purposes such as dusting, surface cleansing of other surfaces, floors as an example. The instance where no material is applied to the brush head is also part of the present invention.

Furthermore, the brush head of the present invention is applicable for medical applications in applying a medicament, medicine or a drug to a subject. In this instance, the material to apply had medicinal purposes and can include a medicament, medicine, or drug. For example, the material may be used to treat acne, dermatitis, infection, immunological conditions such as poison ivy or psoriasis, or other disorders such as but not limited to dermatological disorders. Application of drugs, medicament or medicine to the skin has certain benefits as to targeting the treatment to a desired locus, and also as an efficient route of administration for more systemic administration, particularly if the skin is or is made permeable to the medicament, medicine, or drug. The correlation of the formulation of the material to be applied and the locus of application and the disease, disorder, or condition to be treated are choices of the practitioner. The matching of medicament, drug, or medicine to a disease, disorder, or condition, and the particular formulations are generally known in the art and are choices of the practitioners in the field.

In a further aspect of the present invention, the brush head is a cosmetic brush head.

A preferred aspect of the present invention is a cosmetic applicator brush head, where a cosmetic is provided in a preferred embodiment to the inner zone for application to a surface of a subject, and outer zone preferably disperses the cosmetic on the surface of the subject to allow for reduced streaking and otherwise provide for generally more uniform and pleasing application of the cosmetic to a surface of a subject.

The cosmetic can be of any type, such as but not limited to liquid, solid, powdered, aqueous, non-aqueous, emulsions, polar, non-polar, others as known in the art, or a combination thereof.

Shapes

In an additional aspect of the present invention, the shape of the outer zone and the inner zone are the same or different.

As shown in the figures, a preferred aspect of the present invention is circular or substantially circular, as to the inner zone and outer zone, but that need not be the case. For example, the outer zone may be circular, and the inner zone may be circular or a polygon such as an octagon.

In another aspect of the present invention, the shape of the outer zone, the inner zone, or a combination thereof is generally geometrical, generally non-geometrical, or a combination thereof.

Different geometric or non-geometric configurations in combination are part of the present invention. As an example, the outer zone may be circular or kidney shaped, whereas the inner zone may be hexagonal or amoeboid shaped, indicating the same or different shapes being used and that geometric and non-geometric shapes are also part of the present invention.

In a further aspect of the present invention, the shape of the inner zone, the inner zone, or a combination thereof is generally circular.

As to shape, the overall shape of the brush head when viewed from the side as to the outer zone and inner zone can be flat as shown in the figures. They can separately or individually be the same shape or different shapes, such as angled, beveled, random, convex, concave, geometric, non-geometric or a combination thereof.

When viewed from the side, the brush head can have other configurations, such as the outwardly tapered configuration in the figures, not tapered, inwardly tapered, or other configurations as well.

Bristles

In an additional aspect of the present invention, the bristles can be made of natural material, synthetic material, or a combination thereof.

The bristles can be made of any appropriate material. Natural materials, such as but not limited to animal products such as hair or plant materials such as fibers are useful in the present invention. Synthetic materials such as plastics, polymers, nylon, and other polymers or non-polymers are also useful in the present invention.

In another aspect of the present invention, the said outer zone of bristles and the inner zone of bristles are made of the same or different material or combination of materials.

The brush head of the present invention can be made of all of one type of bristles, or of more than one type of bristles. If more than one type of bristles, they can be provided mixed overall, or in different proportions in different areas of the brush head. The proportions can be anywhere from 0% to 100%

In a further aspect of the present invention, the inner zone of bristles are of a greater pack density than the outer zone of bristles In a preferred aspect of the present invention, the inner zone of bristles is packed more densely as to, for example, a greater number of bristles per unit area, as compared to the outer zoned of bristles. The length of the bristles can affect bristle density, as can the force on the brush head to keep the form in place, such as by a crimper or ferrule. The packing density of the bristles themselves can be achieved during the manufacturing process by having more bristles in some areas than others within the brush head, but that need not be the case.

Beading of Liquid

In another aspect of the present invention, the inner zone of bristles is less wettable than the outer zone of bristles.

Wettability refers to the ability of a liquid to absorb into a surface, such as the inner zone and outer zone of the brush head. Preferably, the wettability of the inner zone is less than the outer zone, so that a liquid material provided to the inner zone would "bead up" or otherwise not absorb into the bristles at that location and thus be more available for application to the subject at the location of application.

Wettability is, in some instances, related to the physical characterizes of the surface and the liquid being applied thereto, and can be measured by contact angle determinations. In one example, a hydrophilic liquid being applied to a hydrophobic surface would bead up on the surface and thus have a relatively high contact angle as compared to the contact angle of a hydrophilic liquid on a hydrophilic surface. In some instances, there is no contact angle as the liquid is absorbed into the surface, such as a drop of water being applied to cellulose filter paper or household tissue paper or paper towels. Contact angle determinations are well known in the art of material science, and one can choose materials and liquids such that a liquid would bead up on a surface or be absorbed into the surface.

In the present invention, the bristle density described herein appears to be related to wettability of the brush head as well, such as in the inner zone. Surfaces can also be coated or otherwise chemically modified to change their surface physical properties such as hydrophobility and hydrophilicity, and thus one can choose or modify materials such that the desired wettability and/or beading is obtained for a particular liquid applied to a surface, such as the inner zone of the brush head of the present invention.

In a preferred aspect of the present invention, the wettability of the inner zone is less than that of the outer zone, allowing the material such as a liquid applied to the inner zone does not absorb into that area of the brush. The outer zone is preferably more wettable as to the material such as a liquid applied to the inner zone.

In a further aspect of the present invention, the inner zone of bristles has a greater or lesser contact angle than said outer zone of bristles with regards to a liquid, an aqueous solution, a polar solution, a non-aqueous solution, a non-polar solution, an emulsion, or a combination thereof.

In an additional aspect of the present invention, the inner zone of bristles is less wettable or more wettable than the outer zone of bristles as to an aqueous solution, a polar solution, a polar liquid, or a combination thereof.

In another aspect of the present invention, the inner zone of bristles is less wettable than the outer zone of bristles as to an non-aqueous solution, a non-polar solution, or a non-polar liquid, or a combination thereof.

In a further aspect of the present invention, the inner zone of bristles is less wettable than the outer zone of bristles as to an emulsion.

In an additional aspect of the present invention, the inner zone of bristles form a reservoir for a material, such as but not limited to a liquid material. As material is applied to a surface, the inner zone of bristles can in essence provide additional material for additional and sustained applications of material.

In another aspect of the present invention, the inner zone of bristles can be partially wettable as to a material, such as not limited to a liquid material. This aspect of the present invention is preferred when the inner zone of bristles acts as a reservoir for material. In this instance, the material can "seep into" the inner zone of bristles and still be available for application to a surface.

Buffing

In another aspect of the present invention, the outer zone has greater buffing characteristics, reduces-streaking characteristics, or a combination thereof, than the inner zone.

In a preferred aspect of the present invention, during operation, the inner zone thus efficiently holds the material in place for application to the surface, and the outer zone acts to smooth, or buff, the application of the material on the surface for a desirable effect. A preferred desirable effect is a reduction in streaking or smearing of the material when applied to a surface, such as but not limited to a liquid cosmetic applied to a human subject.

However, in certain instances, such as for artistic purposes where streaking or smearing have a desirable effect, the present invention includes such aspects as well. Such instances can be, for example, hobby painting and other artistic expressions where incomplete mixing, streaking, shading, feathering, and the like are more desirable than a smooth, buffed appearance.

II Brush

A second aspect of the present invention is a brush that includes at least one brush head of the present invention.

As is generally shown in the figures, the brush head of the present invention is preferably provided as a brush. Included in a brush are preferably, but not limited to at least one brush head, at least one handle, optionally at least one crimping region or ferrule, and any combination thereof.

In a further aspect of the present invention, the brush includes at least one handle.

As is generally shown in the figures, the brush can include at least one handle. In the alternative, the brush can include a handle with one or more brush heads. The handle can be made of any appropriate material known in the art, such as but not limited to wood, plastic, polymer, ceramic, glass, metal, or a combination thereof. The handle can be of unitary construction or made of a plurality of parts. The handle can be made using any appropriate method based on the material, including but not limited to carving, molding, lathing, injection molding, casting, or a combination thereof.

In an additional aspect of the present invention, the brush includes at least one crimping area or ferrule.

As is generally shown in the figures, the brush can include a crimping area or ferrule. The crimping region or ferrule is generally used to keep the bristles of the brush head in its desired configuration. The crimping region or ferrule can also be used to attach a brush head-crimping region/ferrule article of manufacture to a handle. Alternatively, the crimping region or ferrule can be integral to the brush, such as but not limited to being integral to a handle, and in some aspects of the present invention may not be required.

III Method of Making a Brush Head

A third aspect of the present invention is a method of making a brush head of the present invention, including; a) providing bristles; and b) forming the brush head of the present invention.

The brush head of the present invention can be made using the routine methods used in the art. For example, the bristles can be arranged and formed into a brush head, either in final form or in a form that is later modified. Preferably, a crimping zone or ferrule is provided to keep the bristles in a desired configuration, but that need not be the case.

In the instance where the bristles are first formed in a manner that is not the final form, the bristles can be cut in order to provide the final form. For example, the brush head can be trimmed, cut with a cutting implement such as a knife or razor or sizzors, cut with a laser, cut with a hot wire or other implement using heat or other forms of energy, flamed, sanding or other methods known in the art.

In either instance, the brush head can be treated to round or otherwise make the ends of the bristles less sharp or less irritating to skin. Polishing or rounding methods known in the art can be used for this method.

IV Method of Making a Brush

A fourth aspect of the present invention is a method of making a brush of the present invention, including: a) providing bristles; b) forming the brush head of the present invention; and c) attaching the brush head of the present invention to a handle.

Once a brush head is formed, such as with a crimping area or ferrule. The brush head can be attached to a handle. Such methods of attaching a brush head to a handle are known in the art and are readily available and apparent from the literature.

In some instances, a crimping zone or ferrule is present, but that need not be the case.

V Method of Using a Brush Head

A fifth aspect of the present invention is a method of using a brush head of the present invention, including: a) providing a surface to apply a material to; b) providing a brush head of present invention; c) applying a material to the brush head; and d) transferring the material from the brush head to the surface.

In another aspect of the present invention, the surface is a subject.

For certain purposes, such as cosmetic, medicament or medical purposes, the surface is a subject. The subject can be any animal, including non-mammals, mammals, primate and non-primate, and humans. Humans are preferable, but are not necessary.

As set forth herein, the surface need not be a subject, but rather can be any surface of any material to which a material is desired to be delivered. Brush heads are used routinely in painting for profession such as a house or fence, pleasure such as a hobby, or for artistic purposes. For certain applications of the present invention, the reduced streaking and buffing are desirable, and can be incorporated into artistic expressions in, for example, paintings, where a variety of artistic tools are used. One interesting example is the use of the present invention in faux finishes on furniture, walls and ceilings, where the effects desired require tools such as those of the present invention.

In a further aspect of the present invention, the surface is a human.

In one preferred aspect of the present invention, the surface is a human, preferably the skin, and more preferably a surface that is exposed for public view. In that instance, the head, neck and face as to cosmetics is preferable, but that need not be the case, as certain cosmetic are used for concealing certain imperfections in pigmentation, scarring or from other sources. If the subject is human, the human can be male or female.

In an additional aspect of the present invention, the material is a cosmetic.

A preferred aspect of the present invention is one where the material to be provided to a subject is a cosmetic, as is set forth herein. Although a preferred aspect of the present invention, the present invention is clearly applicable to other technologies In another aspect of the present invention, the material is a liquid cosmetic.

Although a preferred aspect of the present invention is a liquid cosmetic, other types of cosmetics are applicable to the present invention. Those include powders, solids, packed powders and the like. Liquid refers to aqueous and non-aqueous liquids as set forth herein, be they polar, non-polar, organic, non-organic, aqueous, non-aqueous, emulsions, water in oil emulsions, oil in water emulsions, or any combination thereof.

In an additional aspect of the present invention, the inner zone of bristles form a reservoir for a material, such as but not limited to a liquid material. As material is applied to a surface, the inner zone of bristles can in essence provide additional material for additional and sustained applications of material.

In another aspect of the present invention, the inner zone of bristles can be partially wettable as to a material, such as not limited to a liquid material. This aspect of the present invention is preferred when the inner zone of bristles acts as a reservoir for material. In this instance, the material can "seep into" the inner zone of bristles and still be available for application to a surface.

VI Method of Using a Brush

A sixth aspect of the present invention is a method of using a brush of the present invention, including: a) providing a surface to apply a material to; b) providing a brush of the present invention; c) applying a material to the brush; and d) transferring the material from the brush head to the surface.

In another aspect of the present invention, the surface is a subject. In a further aspect of the present invention, the surface is a human. In an additional aspect of the present invention, the material is a cosmetic. In another aspect of the present invention, the material is a liquid cosmetic.

As set forth above for the method of using a brush head, the brush of the present invention can be used in the same or similar manner as the brush head and that section above is incorporated by reference herein.

EXAMPLES

Example 1

Development of Technology

This example provides for and establishes the early development of the technology and prototype brush head, brush, methods of making same, and methods of using same.

In order to evaluate the application of Bare Escentuals' cosmetic liquid product (BARESKIN® PURE BRIGHTENING SERUM FOUNDATION, Item Number/Stock Keeping Number 70723, having the general characteristics of a viscous liquid, non-emulsion, specific gravity of 1.13-1.20, viscosity of 580-1,100 cp) application to a human surface, such as a face, a few drops of the liquid product are applied to a Bare Escentuals' standard large brush head made of polymer bristles (PBT—Polybutylene terephthalate) and then the liquid product on the brush head is applied to a human face. The result is streaking of the pigmented liquid product and that the liquid wetted or sank into the brush head.

The brush head is trimmed to a shorter length in "crew cut" type configuration and the application to that surface is repeated and the liquid product is noted not to appreciably wet or sink into the brush head surface but rather beads on the surface of the modified brush head.

The untrimmed brush head is noted to have buffing capability, which is a desirable characteristic for cosmetic application. A brush head with the general characteristics of the figures is made. The liquid product is applied to the central zone of the brush head, and is applied to a human surface, and the streaking of the applied liquid product is diminished or not appreciably observable or not observable. It is thought, though not wishing or intending to be bound by any mechanism, that the beaded up liquid product on the surface of the inner zone enhances application of the liquid product to the application surface, and the outer zone buffs or polishes the applied liquid material for a smooth, relatively or substantially untreated finish.

Further refinements are made and further prototypes and preferred embodiments developed. The product depicted in the figures result from such efforts.

Example 2

Preferred Brush Head and Brush

This example provides for and establishes a preferred aspect of the present invention, as presented in the figures.

A preferred brush head and brush are provided in the figures. A particularly preferred brush head and brush is Bare Escentuals' PERFECTING FACE BRUSH, Item Number/Stock Keeping Number 71184, having the general characteristics of PBT (Polybutylene terephthalate) bristles (0.7 mm PTV WAVE (a wavy/irregular shaped bristle), an anodized aluminum ferrule, and a wooden handle.

Figure 6:
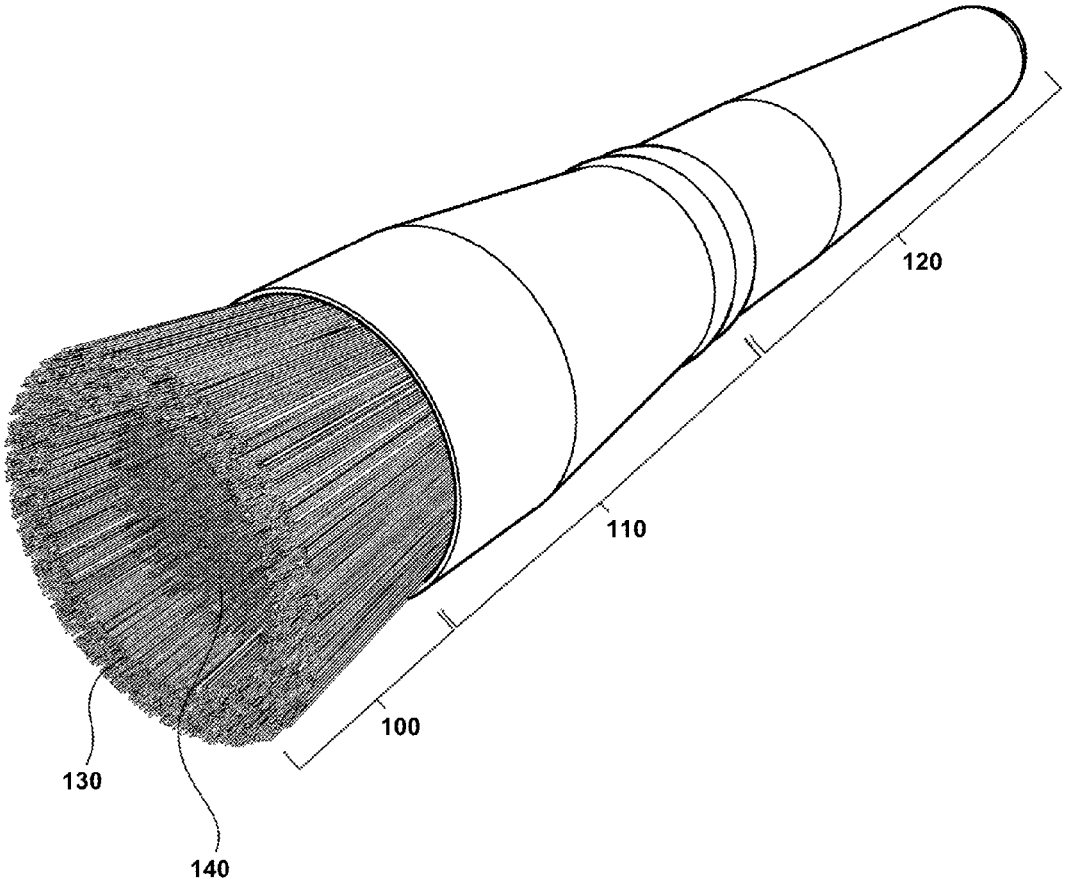
FIG. 6 generally depicts a front and right perspective view of one aspect of a brush of the present invention including a brush head with recessed bristles that can form a reservoir for material to be applied to a surface, such as but not limited to a liquid cosmetic material applied to a human subject's face. The brush includes a brush head (100), a ferrule (110) and a handle (120). The brush head includes an outer zone of bristles (130) and an inner zone of recessed bristles (140).
Figure 7:
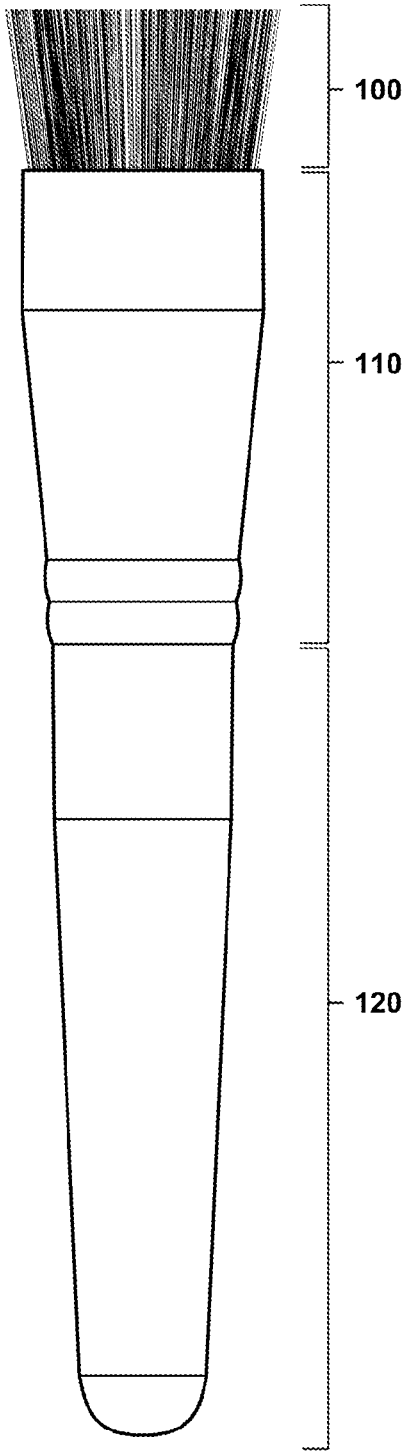
FIG. 7 generally depicts a right side view of one aspect of a brush of the present invention including a brush head with recessed bristles that can form a reservoir for material to be applied to a surface, such as but not limited to a liquid cosmetic material applied to a human subject's face, the left side, front side, and back side being mirror image thereof. The element numbers as are provided in FIG. 6.
Figure 8:
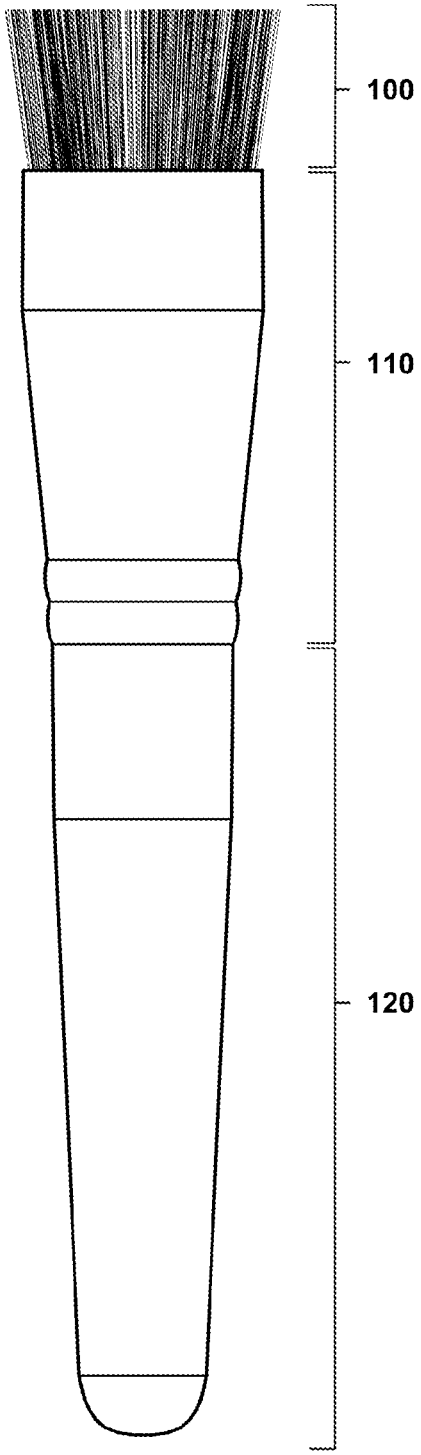
FIG. 8 generally depicts a left side, front side, and back side view of one aspect of a brush of the present invention including a brush head with recessed bristles that can form a reservoir for material to be applied to a surface, such as but not limited to a liquid cosmetic material applied to a human subject's face, as per FIG. 7. The element numbers as are provided in FIG. 6.
Figure 9:
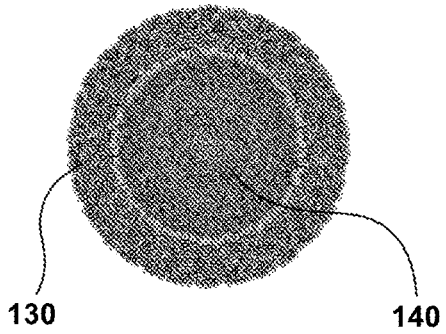
FIG. 9 generally depicts a top view of one aspect of a brush of the present invention including a brush head with recessed bristles that can form a reservoir for material to be applied to a surface, such as but not limited to a liquid cosmetic material applied to a human subject's face. The element numbers as are provided in FIG. 6.
Figure 10:
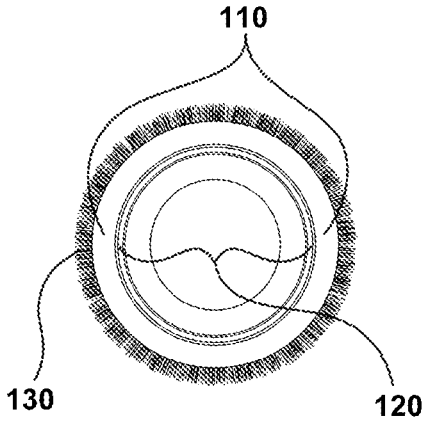
FIG. 10 generally depicts a bottom view of one aspect of a brush of the present invention including a brush head with recessed bristles that can form a reservoir for material to be applied to a surface, such as but not limited to a liquid cosmetic material applied to a human subject's face. The element numbers as are provided in FIG. 6.
Figure 11:
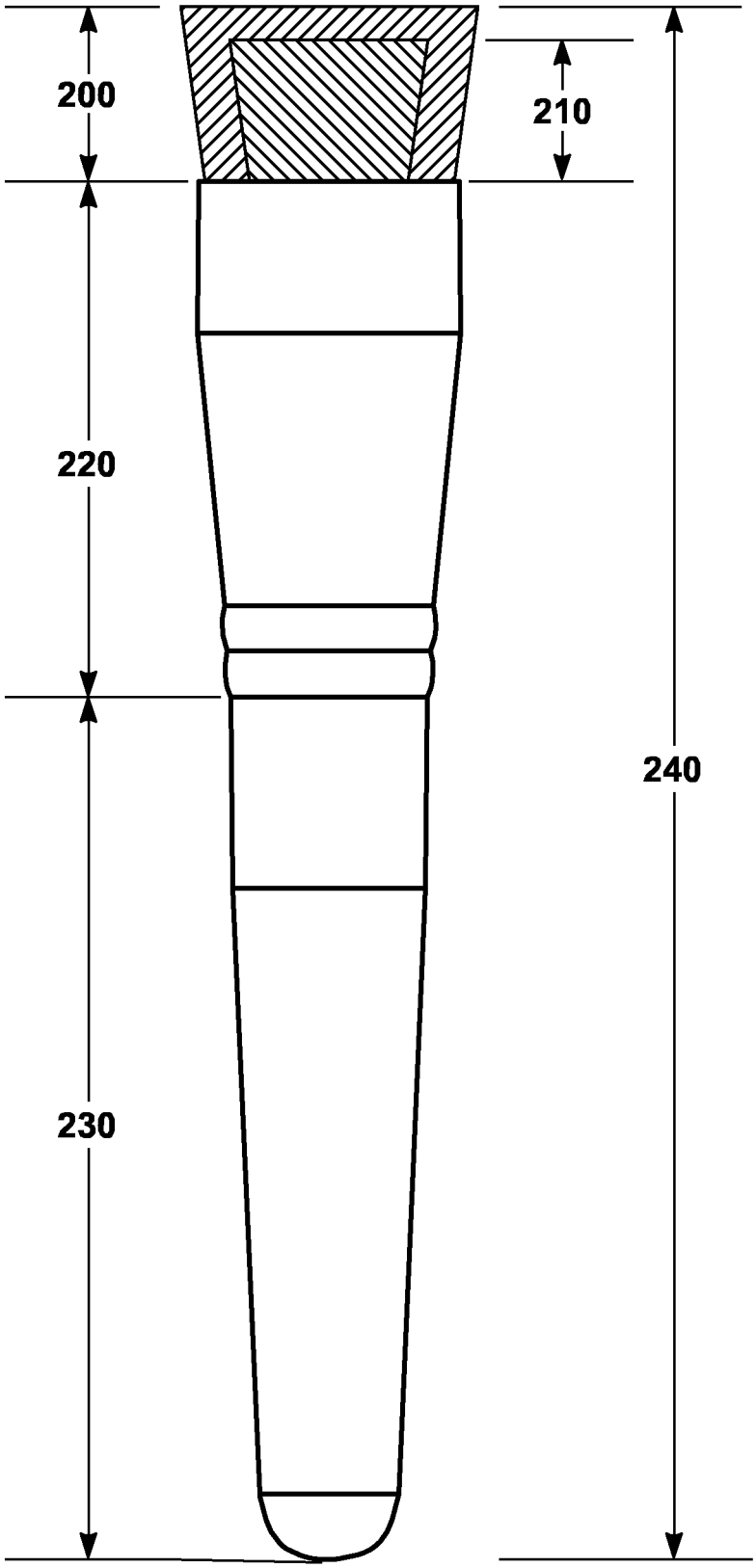
FIG. 11 generally depicts a preferred brush of the present invention including a brush head with recessed bristles that can form a reservoir for material to be applied to a surface, such as but not limited to a liquid cosmetic material applied to a human subject's face, showing preferred dimensions as follows. For example, the invention not being limited to the particular dimensions or ratios, 200 being about 16.5 mm, 210 being about 13.5 mm, 220 being about 45 mm, 230 being about 75 mm, and 240 being about 136.5 mm. The error is between about +/−about 0.1% and about 10% , preferably between about 0.5% to about 5% , and more preferably between about 1% and about 2% . The particular sizes and ratios can be adapted to a particular brush head or brush for a particular purpose and function. The brush head is shown in cross hatch of differing angles to highlight the difference between the outer zone of bristles and the inner zone of bristles in order to show the dimensions clearly.

As shown in FIG. 1 and FIG. 6, the brush can include a brush head (100), a ferrule (110) and a handle (120). The brush bead can include an outer zone of bristles (130) and an inner zone of recessed bristles (140), Overall, FIG. 1, FIG. 2, FIG. 3, FIG. 4, FIG. 5, FIG. 6, FIG. 7, FIG. 8, FIG. 9, FIG. 10, and FIG. 11 all show preferred brush heads and brushes of the present invention, such as Bare Escentuals' PERFECTING FACE BRUSH, Item Number/Stock Keeping Number 71184, having the general characteristics of PBT (Polybutylene terephthalate) bristles (0.7 min PTV WAVE (a wavy/irregular shaped bristle), an anodized aluminum ferrule, and a wooden handle. The general dimensions are provided in FIG. 11. FIG. 11 also provides preferred dimensions and preferred ratios of dimensions of the particularly preferred brush and brush head of the present invention in mm. For example, the invention not being limited to the particular dimensions or ratios, 200 being about 16.5 mm, 210 being about 13.5 mm, 220 being about 45 mm, 230 being about 75 mm, and 240 being about 136.5 mm. The error is between about +/−about 0.1% and about 10%, preferably between about 0.5% and about 5%, and more preferably between about 1% and about 2% . The particular sizes and ratios can be adapted to a particular brush head or brush for a particular purpose and function.

Example 3

Preferred Method of Making the Preferred Brush Head and Brush

This example provides for and establishes a preferred aspect of the present invention, as presented in the figures.

Generally, the brush head and brush of the present invention are made in the general manner known in the art. Bristles in a non-final configuration are attached to the handle by way of the ferrule. The bristles are then shaped into the desired configuration by way of trimming.

As show in FIG. 1 and FIG. 6, the brush can include a brush head (100), a ferrule (110) and a handle (120). The brush head includes an outer zone of bristles (130) and an inner zone of recessed bristles (140). Overall, FIG. 1, FIG. 2, FIG. 3, FIG. 4, FIG. 5, FIG. 6, FIG. 7, FIG. 8, FIG. 9, FIG. 10, and FIG. 11 all show preferred brush heads and brushes of the present invention.

Example 4

Preferred Method of Using the Preferred Brush Head and Brush

This example provides for and establishes a preferred aspect of the present invention, as presented in the figures.

The user grasps the handle of the brush, such as Bare Escentuals' PERFECTING FACE BRUSH, Item Number/Stock Keeping Number 71184 and applies the cosmetic to the inner zone. In the preferred aspect of the present invention, a few drops of a liquid cosmetic materials, such as BARESKIN® PURE BRIGHTENING SERUM FOUNDATION, Item Number/Stock Keeping Number 70723, are used. The user then optionally dabs or dots the cosmetic from the surface from the inner zone of the brush head, such as the user's or other subject's skin. The cosmetic can be applied to the surface in any desired pattern or amount for a desired outcome. The cosmetic is thus applied to that surface. The brush is used to buff the cosmetic for a desirable non-streaked, consistent and "clean" application. Optionally, the cosmetic is not so dabbed or dotted onto the subject, but rather simultaneously applied and buffed to likewise obtain a desired result.

As show in FIG. 1 and FIG. 6, the brush can include a brush head (100), a ferrule (110) and a handle (120). The brush head includes an outer zone of bristles (130) and an inner zone of recessed bristles (140). Overall, FIG. 1, FIG. 2, FIG. 3, FIG. 4, FIG. 5, FIG. 6, FIG. 7, FIG. 8, FIG. 9, FIG. 10, and FIG. 11 all show preferred brush heads and brushes of the present invention.

The general dimensions are provided in FIG.11. FIG.11 also provides preferred dimensions and preferred ratios of dimensions of the particularly preferred brush and brush head of the present invention in mm. For example, the invention not being limited to the particular dimensions or ratios, 200 being about 16.5 mm, 210 being about 13.5 mm, 220 being about 45 mm, 230 being about 75 mm, and 240 being about 136.5 mm. The error is between about +/−about 0.1% and about 10%, preferably between about 0.5% and about 5%, and more preferably between about 1% and about 2% . The particular sizes and ratios can be adapted to a particular brush head or brush liar a particular purpose and function.

The user can also optionally apply the cosmetic to the outer zone as desired to obtain a desired outcome under circumstances that dictate departure from preferred uses as indicated. The entire surface, such as a human face, can be treated, or just a portion thereof.

The process generally distributes the cosmetic such as a foundation evenly, removes excess product, and gives it a more skin-like texture and appearance than when alternative brushes or methods are used.

In a preferred aspect of the present invention, the user drops liquid foundation product into the recessed bristle area having material application and buffing properties. The "loaded" brush is then then applied in a dotting motion to areas around the face to disperse the product on the face. The user then buffs the brush over the dots to evenly distribute the product over the entire facial area or desired smaller section. Preferably, at no point does the user need to apply the product anywhere other than the brush and face. For example, the fingers and hands of the user can preferably stay clean and free or substantially free of or from product throughout the duration of the use of the brush. This aspect of the present invention has certain advantages, such as not carrying or transferring material to other surfaces or objects, including but not limited to clothing and furniture.

In an additional preferred aspect of the present invention, the inner zone of bristles form a reservoir for a material, such as but not limited to a liquid material. As material is applied to a surface, the inner zone of bristles can in essence provide additional material for additional and sustained applications of material.

In another preferred aspect of the present invention, the inner zone of bristles can be partially wettable as to a material, such as not limited to a liquid material. This aspect of the present invention is preferred when the inner zone of bristles acts as a reservoir for material. In this instance, the material can "seep into" the inner zone of bristles and still be available for application to a surface.

All publications, including patent documents and scientific articles, referred to in this application and the bibliography and attachments, are incorporated by reference in their entirety for all purposes to the same extent as if each individual publication were individually incorporated by reference.

All headings are for the convenience of the reader and should not be used to limit the meaning of the text that follows the heading, unless so specified.

What is claimed is:

1. A system for applying a liquid cosmetic using a brush head, comprising:

a brush head comprising:

a) an outer zone of bristles, and b) an inner zone of bristles, wherein a height of said inner zone of bristles is about 74% to about 90% of a height of said outer zone of bristles, wherein said inner zone of bristles has a pack density that is greater than a pack density of said outer zone of bristles, and wherein said inner zone of bristles and said outer zone of bristles define a reservoir configured for holding a liquid cosmetic in place for application to a surface.

2. The system of claim 1, wherein said brush head is a cosmetic brush head.

3. The system of claim 1, wherein a circumferential shape of said outer zone and of said inner zone in a transverse cross-sectional view are the same.

4. The system of claim 1, wherein a shape of said outer zone, said inner zone, or a combination thereof in a transverse cross-sectional view is generally geometrical, generally non-geometrical, or a combination thereof.

5. The system of claim 1, wherein a shape of said inner zone, said outer zone, or a combination thereof in a transverse cross-sectional view is generally circular.

6. The system of claim 1, wherein said bristles comprise natural material, synthetic material, or a combination thereof.

7. The system of claim 1, wherein said outer zone of bristles and said inner zone of bristles each comprise the same material, different materials or each comprise a combination of materials.

8. The system of claim 1, wherein said inner zone of bristles is less wettable than said outer zone of bristles.

9. The system of claim 1, wherein said inner zone of bristles has a greater or lesser contact angle than said outer zone of bristles with regard to a liquid, an aqueous solution, a polar solution, a non-aqueous solution, a non-polar solution, an emulsion, or a combination thereof.

10. The system of claim 1, wherein said inner zone of bristles is less wettable or more wettable than said outer zone of bristles as to an aqueous solution, a polar solution, a polar liquid, or a combination thereof.

11. The system of claim 1, wherein said outer zone has greater buffing characteristics, streak-reducing characteristics, or a combination thereof, than said inner zone.

12. A system for applying a liquid cosmetic using a brush, comprising a brush having at least one brush head of claim 1.

13. The system of claim 12,
further comprising at least one handle.

14. The system of claim 12,
further comprising at least one crimping area or ferrule.

15. The brush head according to claim 1, wherein said outer zone of bristles is outwardly tapered; and said tapered outer zone of bristles is configured for smoothing and/or buffing a liquid cosmetic applied to a surface from within said reservoir.

16. The brush head according to claim 1, wherein said bristles in said outer zone and/or said inner zone have a wavy surface pattern, wherein the wavy surface pattern is defined by the tips of the bristles in said inner zone and/or said outer zone.

17. A method of using a brush head for applying a liquid cosmetic, comprising:
a) providing a surface on which to apply a liquid cosmetic;
b) providing a brush head comprising:
an outer zone of bristles, and
an inner zone of bristles, wherein a height of said inner zone of bristles is about 74% to about 90% of a height of said outer zone of bristles, wherein said inner zone of bristles has a pack density that is greater than a pack density of said outer zone of bristles, and wherein said inner zone of bristles and said outer zone of bristles define a reservoir;
c) applying the liquid cosmetic to said reservoir, wherein said reservoir retains said liquid cosmetic therein; and
d) transferring said liquid cosmetic from said brush head to said surface.

18. The method of claim 17,
wherein said surface is a human.

19. A method of using a brush for applying a liquid cosmetic, comprising:
a) providing a surface on which to apply a liquid cosmetic;
b) providing a brush head comprising:
an outer zone of bristles, and
an inner zone of bristles, wherein a height of said inner zone of bristles is about 74% to about 90% of a height of said outer zone of bristles, wherein said inner zone of bristles has a pack density that is greater than a pack density of said outer zone of bristles, and wherein said inner zone of bristles and said outer zone of bristles define a reservoir;
c) applying the liquid cosmetic to said reservoir, wherein said reservoir retains the liquid cosmetic therein; and
d) transferring said liquid cosmetic from said brush head to said surface.

20. The method of claim 19, wherein said surface is a human.

21. A system for applying a liquid cosmetic, comprising:
a brush head comprising:
a) an outer zone of bristles, and
b) an inner zone of bristles, wherein said outer zone of bristles is outwardly tapered; wherein said inner zone of bristles and said tapered outer zone of bristles define a reservoir configured for holding a liquid cosmetic in place for application to a surface and said tapered outer zone of bristles is configured for smoothing and/or buffing a liquid cosmetic applied to a surface from within said reservoir.

22. The system according to claim 21, wherein a height of said inner zone of bristles is about 74% to about 90% of a height of said outer zone of bristles.

23. The system according to claim 21, wherein said outer zone and/or said inner zone of bristles comprise a wavy surface pattern, wherein the wavy surface pattern is defined by the tips of the bristles in said inner zone and/or said outer zone.

24. A cosmetic brush head, comprising:
a) an outer zone of bristles, and
b) an inner zone of bristles, wherein said inner zone of bristles and said outer zone of bristles define a reservoir configured for holding a liquid cosmetic in place for application to a surface, wherein said bristles in said outer zone and/or said inner zone of bristles comprise a wavy surface pattern, and wherein the wavy surface pattern is defined by the tips of the bristles in said inner zone and/or said outer zone.

25. The brush head according to claim 24, wherein said outer zone of bristles is outwardly tapered; and said tapered outer zone of bristles is configured for smoothing and/or buffing a liquid cosmetic applied to a surface from within said reservoir.

26. The brush head according to claim 24, wherein a height of said inner zone of bristles is about 74% to about 90% of a height of said outer zone of bristles.

27. A brush head, comprising:
a) an outer zone of bristles, and
b) an inner zone of bristles, wherein a height of said inner zone of bristles is about 74% to about 90% of a height of said outer zone of bristles,
wherein said outer zone of bristles is outwardly tapered; wherein said inner zone of bristles and said tapered outer zone of bristles define a reservoir configured for holding a liquid cosmetic in place for application to a surface and said tapered outer zone of bristles is configured for smoothing and/or buffing a liquid cosmetic applied to a surface from within said reservoir; and
wherein said bristles in said outer zone and/or said inner zone have a wavy surface pattern, wherein the wavy surface pattern is defined by the tips of the bristles in said inner zone and/or said outer zone.

28. A system for applying a liquid cosmetic using a brush head, comprising:
a brush head comprising:
a) a tapered outer zone of bristles, and
b) a reservoir defined in an inner zone within the outer zone of bristles configured for holding a liquid cosmetic in place for application to a surface and said tapered outer zone of bristles configured for smoothing and/or buffing a liquid cosmetic applied to a surface from within said reservoir, wherein the reservoir has a height that is about 74% to about 90% of a height of said outer zone of bristles.

29. The system of claim 28, wherein the outer zone of bristles has a wavy surface pattern, wherein the wavy surface pattern is defined by the tips of the bristles in said inner zone and/or said outer zone.

30. A method for applying a liquid cosmetic, comprising
providing a brush head comprising
an outer zone of bristles, and
an inner zone of bristles, wherein a height of said inner zone of bristles is about 74% to about 90% of a height of said outer zone of bristles, wherein said inner zone of bristles has a pack density that is greater than a pack density of said outer zone of bristles, and wherein said inner zone of bristles and said outer zone of bristles define a reservoir;

applying a liquid cosmetic to a surface using the brush head.

31. A method of using a brush head for applying a liquid cosmetic, comprising:

a) providing a surface on which to apply a liquid cosmetic;

b) providing a brush head comprising:

an outer zone of bristles, and an inner zone of bristles, wherein said inner zone of bristles has a pack density that is greater than a pack density of said outer zone of bristles, and wherein said inner zone of bristles and said outer zone of bristles define a reservoir;

c) applying the liquid cosmetic to said reservoir, wherein said reservoir retains said liquid cosmetic therein; and d) transferring said liquid cosmetic from said brush head to said surface.

32. A method of using a brush for applying a liquid cosmetic, comprising:

a) providing a surface on which to apply a liquid cosmetic;

b) providing a brush head comprising:

an outer zone of bristles, and an inner zone of bristles, wherein said inner zone of bristles has a pack density that is greater than a pack density of said outer zone of bristles, and wherein said inner zone of bristles and said outer zone of bristles define a reservoir;

c) applying the liquid cosmetic to said reservoir, wherein said reservoir retains the liquid cosmetic therein; and d) transferring said liquid cosmetic from said brush head to said surface.

* * * * *